US010648223B2

(12) United States Patent
Graham et al.

(10) Patent No.: US 10,648,223 B2
(45) Date of Patent: May 12, 2020

(54) HIGH SURFACE ENERGY WINDOW SPACER ASSEMBLIES

(71) Applicant: Andersen Corporation, Bayport, MN (US)

(72) Inventors: Katherine April Stephan Graham, Inver Grove Heights, MN (US); Brian Patrick Parker, New Richmond, WI (US); Robert Joseph Wolf, Woodbury, MN (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 15/699,348

(22) Filed: Sep. 8, 2017

(65) Prior Publication Data

US 2018/0073292 A1 Mar. 15, 2018

Related U.S. Application Data

(60) Provisional application No. 62/385,707, filed on Sep. 9, 2016.

(51) Int. Cl.
*E06B 3/673* (2006.01)
*E06B 3/66* (2006.01)
(Continued)

(52) U.S. Cl.
CPC ..... *E06B 3/67304* (2013.01); *E06B 3/66328* (2013.01); *E06B 3/67343* (2013.01);
(Continued)

(58) Field of Classification Search
CPC .. E06B 3/67304; E06B 3/6733; E06B 3/6621; E06B 3/6715
See application file for complete search history.

(56) References Cited

U.S. PATENT DOCUMENTS 3,900,538 A 8/1975 Kawakami
4,310,587 A * 1/1982 Beaupre ..... B32B 15/08 442/31
(Continued)

FOREIGN PATENT DOCUMENTS

EP 2719533 4/2014
JP 08013937 A * 1/1996
(Continued)

OTHER PUBLICATIONS

TriStar: Surface Energy of Plastics <https://www.tstar.com/blog/bid/33845/surface-energy-of-plastics> (Year: 2009).*
(Continued)

*Primary Examiner* — Brent W Herring
(74) *Attorney, Agent, or Firm* — Pauly, DeVries Smith & Deffner LLC

(57) ABSTRACT

Embodiments herein relate to window spacer assemblies including surfaces with relatively high surface energy. In an embodiment, a window spacer assembly is included. The window spacer assembly including a spacer body having an inner surface, an outer surface, and lateral surfaces. The window spacer assembly further includes a first sealant disposed on the lateral surfaces. Portions of the window spacer assembly such as an outer surface or lateral surface of the spacer body and/or a moisture vapor barrier layer disposed over the outer surface can be treated to have a higher surface energy. Other embodiments are also included herein.

15 Claims, 10 Drawing Sheets

(51) Int. Cl.
*E06B 3/663* (2006.01)
*E06B 3/67* (2006.01)

(52) U.S. Cl.
CPC ..... *E06B 3/6621* (2013.01); *E06B 3/6715* (2013.01); *E06B 3/6733* (2013.01); *E06B 2003/6638* (2013.01)

(56) References Cited

U.S. PATENT DOCUMENTS 4,563,843 A * 1/1986 Grether ..... E06B 3/64 49/DIG. 1
5,750,225 A * 5/1998 Petty ..... B32B 29/02 428/36.2
5,962,090 A * 10/1999 Trautz ..... E06B 3/66319 428/34
6,035,602 A * 3/2000 Lafond ..... E06B 3/66328 156/109
6,393,768 B1 * 5/2002 Roche ..... A47F 3/0434 49/501
6,976,102 B1 12/2005 Groen et al.
6,984,287 B2 1/2006 Zhang
7,954,283 B1 * 6/2011 Tinianov ..... E06B 3/66333 52/204.593
8,402,716 B2 * 3/2013 Tinianov ..... E06B 3/66333 49/501
8,534,006 B2 * 9/2013 Roche ..... A47F 3/0434 427/385.5
8,701,363 B2 * 4/2014 Schield ..... B32B 17/10045 428/331
9,803,415 B2 * 10/2017 Ferri ..... E06B 3/66328
10,125,535 B2 * 11/2018 Mader ..... E06B 3/66366
2003/0157346 A1 * 8/2003 Kawamura ..... B32B 27/14 428/451
2004/0020162 A1 * 2/2004 Baratuci ..... E06B 3/66309 52/786.13
2004/0166322 A1 * 8/2004 Suzuki ..... C04B 35/03 428/411.1
2005/0028458 A1 * 2/2005 Rosskamp ..... E06B 3/24 52/172
2005/0124241 A1 * 6/2005 Malik ..... B32B 11/04 442/48
2005/0227025 A1 * 10/2005 Baratuci ..... E06B 3/66309 428/34
2006/0104710 A1 * 5/2006 Lafond ..... E06B 3/66314 403/205
2009/0266015 A1 * 10/2009 Schield ..... B32B 17/10045 52/204.62
2009/0301637 A1 * 12/2009 Reichert ..... E06B 3/66314 156/109
2010/0055430 A1 * 3/2010 Wilkerson ..... B32B 5/18 428/215
2010/0139193 A1 * 6/2010 Goldberg ..... B32B 7/12 52/309.3
2010/0139195 A1 * 6/2010 Tinianov ..... E06B 3/66333 52/309.13
2010/0255224 A1 10/2010 Gubbels et al.
2011/0197530 A1 * 8/2011 Bahnmiller ..... B32B 5/14 52/309.4
2012/0141699 A1 * 6/2012 Mader ..... E06B 3/66366 428/34
2015/0233173 A1 * 8/2015 Ferri ..... E06B 3/66328 428/121

FOREIGN PATENT DOCUMENTS

WO 2012140005 10/2012
WO 2018049176 3/2018

OTHER PUBLICATIONS

Technibond Surface Energy Chart <http://www.technibond.co.uk> (Year: 2018).*
TWI: Table of surface energy values of solid materials <https://www.twi-global.com/technical-knowledge/faqs> (Year: 2018).*
Dyne Levels Part 1—Paper, Film & Foil Converter <http://pffc-online.com/processmanagement/6240-dyne-levels-part-1-0608> (Year: 2008).*
What is Mylar?, Sorbent Systems, <https://www.sorbentsystems.com/mylarinfo.html> (Year: 2019).*
"International Search Report and Written Opinion," for PCT Application No. PCT/US2017/050701 dated Dec. 12, 2017 (12 pages).

* cited by examiner

HIGH SURFACE ENERGY WINDOW SPACER ASSEMBLIES

This application claims the benefit of U.S. Provisional Application No. 62/385,707, filed Sep. 9, 2016, the content of which is herein incorporated by reference in its entirety.

FIELD

Embodiments herein relate to window spacer assemblies including surfaces with relatively high surface energy.

BACKGROUND

Glazing units frequently include two or more sheets of glass separated from one another by a space. The space (or insulating space) in between the sheets of glass can be filled with a gas (such as air, argon or krypton) to enhance insulating properties. A window spacer assembly is a structure that is frequently disposed between the sheets of glass around the periphery. The window spacer assembly serves various purposes. As one example, the window spacer assembly helps make the space between the sheets uniform around all of the edges. As another example, the window spacer assembly forms a gas-tight seal around the edges of the insulating space to hold the desired gas in place and prevent gas leakage. Failure of the seal provided by the window spacer assembly can lead to poor insulating performance and ingression of moisture into the insulating space. Moisture ingression into the unit can lead to moisture condensation on the glass surface, corrosion of coatings (such as low e coatings) or other defects.

SUMMARY

Embodiments herein relate to window spacer assemblies including surfaces with relatively high surface energy. In an embodiment, a window spacer assembly is include herein. The window spacer assembly can include a spacer body having an inner surface, outer surface, and lateral surfaces. A first sealant can be disposed on the lateral surfaces. A moisture vapor barrier layer can be disposed over the outer surface, the moisture vapor barrier layer can have an inner surface and an outer surface. The outer surface of the moisture vapor barrier layer can have a different surface energy than the inner surface.

In an embodiment, a method for making a glazing unit is included herein. The method can include treating an outer surface of a window spacer assembly to increase the surface energy thereof. The method can further include depositing the window spacer assembly around the outer perimeter of a first sheet of glass. The method can further include attaching a second sheet of glass onto the window spacer assembly, such that the window spacer assembly is disposed between the first sheet of glass and the second sheet of glass. The method can further include applying a sealant layer on the outer surface of the window spacer assembly between the first sheet of glass and the second sheet of glass.

In an embodiment, a window spacer assembly is included herein. The window spacer assembly can include a spacer body defining an interior cavity. The spacer body can include surfaces facing the interior cavity and surfaces facing away from the interior cavity. The window spacer assembly can include a first sealant disposed on at least some of the surfaces facing away from the interior cavity. Surfaces of the spacer body facing the interior cavity can have a different surface energy than at least some of the surfaces facing away from the interior cavity.

In an embodiment, a window spacer assembly is included. The spacer body can define an interior volume and can include one or more metal wall members. The spacer body can include external surfaces including an inner surface, outer surface, and lateral surfaces and internal surfaces bordering the interior volume. One or more of the outer surface and lateral surfaces can have a different surface energy than the internal surfaces bordering the interior volume.

In an embodiment, a glazing unit is included. The glazing unit can include a first sheet of glass, a second sheet of glass and a window spacer assembly disposed between the first and the second sheet of glass. The window spacer assembly can be according to any of the window spacer embodiments described herein.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following drawings, in which.

Figure 1:
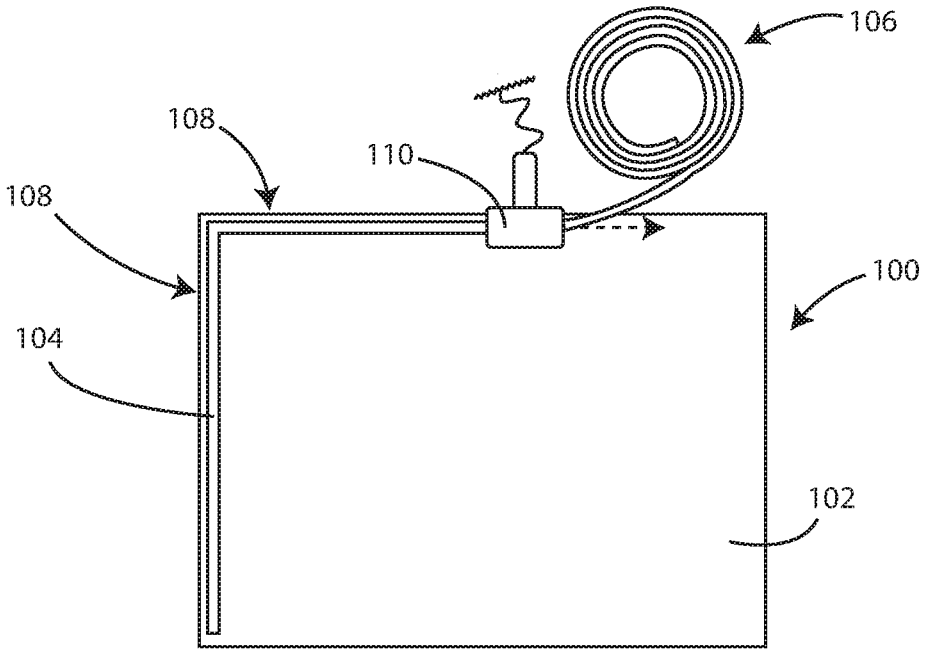
FIG. 1 is a schematic view of a glazing unit during assembly in accordance with various embodiments herein.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

The embodiments described herein are not intended to be exhaustive or to limit the invention to the precise forms disclosed in the following detailed description. Rather, the embodiments are chosen and described so that others skilled in the art can appreciate and understand the principles and practices.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Window spacer assemblies can help form a gas-tight seal around the edges of the insulating space in an insulated glazing unit to hold a desired gas in place and prevent gas leakage. Failure of the seal provided by the window spacer assembly can lead to poor insulating performance and ingression of moisture into the insulating space. In some cases, the use of a sealant (first or second, primary or secondary, including that applied at the time of glazing unit assembly) can be important in maintaining the bond between the sheets of glass in the glazing unit and the window spacer assembly.

However, it has been discovered that window spacer assemblies can have surfaces that do not allow for adequate bonding of the primary or secondary sealant thereto. In specific, some window spacer assemblies can include one or more surfaces with relatively low surface energies that are not conducive to desirable levels of adhesive bonding. In various embodiments herein, one or more surfaces of a window spacer assembly are treated in order to increase the surface energy thereof to allow for enhanced bonding of sealants thereto.

Window spacer assemblies, or components thereof, are typically manufactured in a facility that is separate from the facility where the glazing unit is assembled. As such, window spacer assemblies are manufactured and then stored and shipped to a separate facility before their use in the manufacture of a glazing unit. In some cases, the window spacers are rolled up after manufacture to allow for efficient packaging and shipment. However, it has been discovered that storage and/or packaging can degrade or contaminate the surface properties of a window spacer assembly. In specific, even if a window spacer assembly may initially have desirable surface properties, such as a relatively high surface energy, these surface properties may degrade by the time the window spacer assembly is used in the manufacture of a glazing unit. As such, in various embodiments herein, window spacer assemblies are treated to enhance their surface energy during, or immediately prior to, the process of manufacturing a glazing unit.

Referring now to FIG. 1, a schematic view of a glazing unit 100 during assembly is shown in accordance with various embodiments herein. The glazing unit 100 includes a first sheet of glass 102. A window spacer assembly 104 is disposed onto the first sheet of glass 102 adjacent to the peripheral edges 108 of the first sheet of glass 102. The window spacer assembly 104 can be placed onto the first sheet of glass 102 in various ways. In some examples, a placement device 110 can be used to assist in the process of placing the window spacer assembly 104 on the first sheet of glass 102. In some cases, the window spacer assembly 104 can be fed into the placement device 110 from a roll 106. The placement device 110 can be hand operated or can be automated, such as with an assembly automation system.

Figure 2:
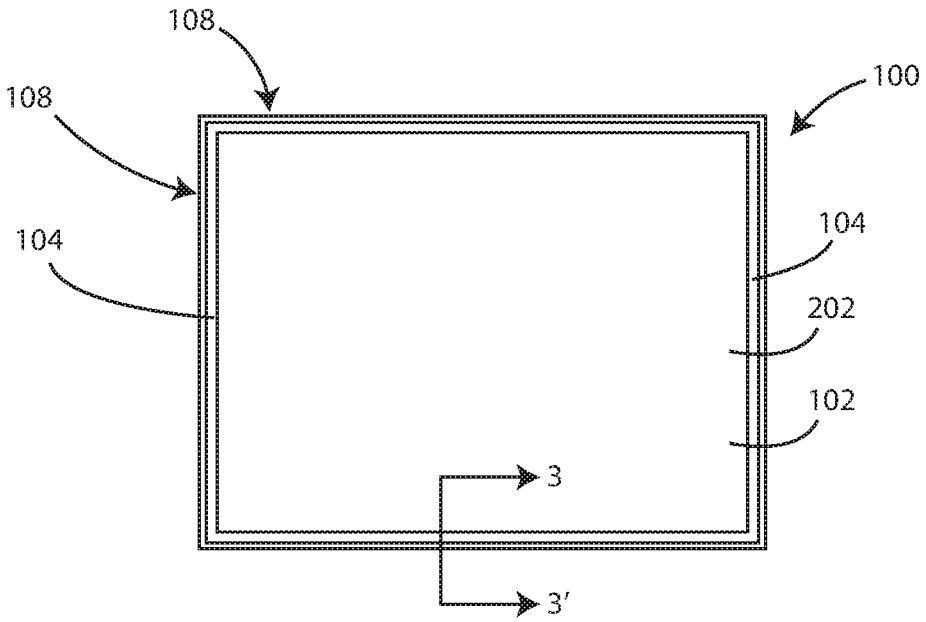
FIG. 2 is a schematic view of a glazing unit in accordance with various embodiments herein.

Referring now to FIG. 2, a schematic view of a glazing unit 100 is shown in accordance with various embodiments herein. The glazing unit 100 includes a first sheet of glass 102 and a second sheet of glass 202. The glazing unit 100 includes a window spacer assembly 104 disposed between the first sheet of glass 102 and the second sheet of glass 202. The window spacer assembly 104 is disposed around the peripheral edges 108 of the sheets of glass (102 and 202).

Figure 3:
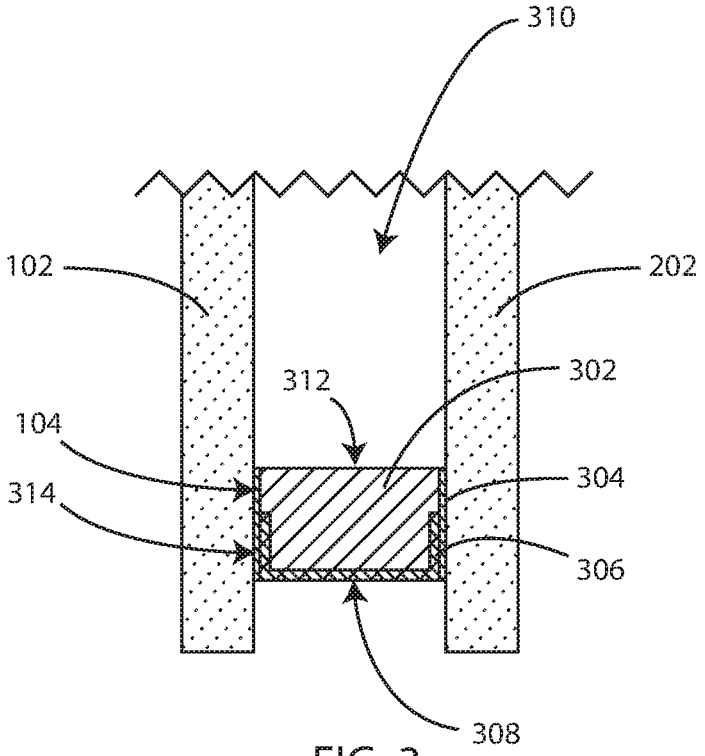
FIG. 3 is a partial cross-sectional view of a glazing unit in accordance with various embodiments as taken along line 3-3' of FIG. 2.

Referring now to FIG. 3, a partial cross-sectional view of a glazing unit is shown in accordance with various embodiments as taken along line 3-3' of FIG. 2. A window spacer assembly 104 is disposed between the first sheet of glass 102 and the second sheet of glass 202. The window spacer assembly 104 physically spaces the sheets of glass apart from one another resulting in an interior insulating space 310. The window spacer assembly 104 a spacer body 302. The spacer body 302 includes an inner surface 312, an outer surface 308, and lateral surfaces 314. The window spacer assembly 104 further includes a first sealant 304 disposed on the lateral surfaces 314 of the spacer body 302. In some cases the first sealant 304 can be applied at the time of window spacer assembly manufacture. In other cases, the first sealant 304 can be applied later at the time of glazing unit assembly. The length of the first sealant 304 along the lateral sides can vary. In some cases, the first sealant 304 can cover the entire lateral side(s) of the window spacer assembly. In other embodiments, the first sealant 304 covers only a portion of the lateral side(s) of the window spacer assembly. The window spacer assembly 104 further includes a moisture vapor barrier layer 306 disposed over the outer surface 308 of the spacer body 302.

The spacer body can be formed of various materials. In some embodiments, the spacer body can include a deformable polymer. In some embodiments, the spacer body can include an elastomeric polymer. In some embodiments, the spacer body can include a polymer selected from the group including polyethylene, polypropylene, polyethylene terephthalate, polyimides, polyamides, polyurethanes, polysiloxanes, polyphenylenes, polyphenylene oxides, polyaramides, polysulfones, and polycarbonates. In some embodiments, the spacer body can include a metal. Metals can include, but are not limited to aluminum, alloys such as stainless steel, and the like.

In various embodiments herein, a secondary sealant can be applied over at least a portion of the outer surface of the window spacer assembly. The secondary sealant can contact the first and second sheets of glass and provide for more robust adhesion of the window spacer assembly with the first and second sheets of glass.

Figure 4:
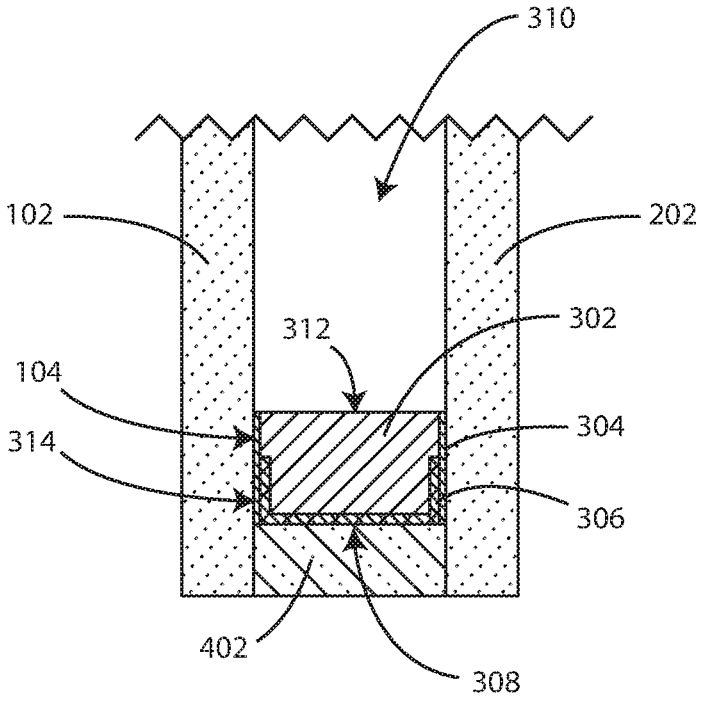
FIG. 4 is a partial cross-sectional view of a glazing unit in accordance with various embodiments as taken along line 3-3' of FIG. 2 showing the placement of a second sealant on the outer surface of the moisture vapor barrier layer.

Referring now to FIG. 4, a partial cross-sectional view is shown of a glazing unit in accordance with various embodiments as taken along line 3-3' of FIG. 2 showing the placement of a second sealant 402 on the outer surface of the moisture vapor barrier layer 306.

In various embodiments, the window spacer assembly, or portions thereof, can be treated so as to alter the surface energy of one or more surfaces of the window spacer assembly. In some embodiments, the window spacer assembly can be treated before it is applied to one or more sheets of glass.

Figure 5:
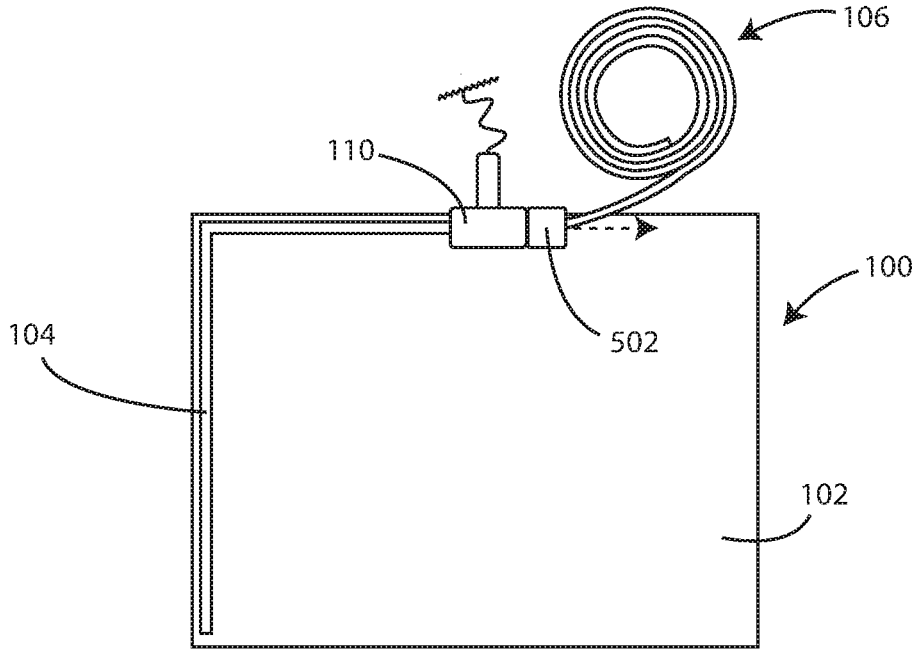
FIG. 5 is a schematic view of a glazing unit during assembly in accordance with various embodiments herein.

Referring now to FIG. 5, a schematic view is shown of a glazing unit 100 during assembly in accordance with various embodiments herein. In this view, a window spacer assembly 104 is shown being applied to a first sheet of glass 102. In this example, the window spacer assembly 104 can be fed off of a roll 106 and into a surface treatment device 502 that can alter the surface energy of at least one surface of the window spacer assembly 104. Exemplary treatments are described below. After surface energy enhancing treatment, the window spacer assembly 104 can be fed into a placement device 110 that can be used to assist in the process of placing the window spacer assembly 104 on the first sheet of glass 102. In some embodiments, the surface treatment device 502 can be integral with the placement device 110. In other embodiments, the surface treatment device 502 can be separate from the placement device 110.

While the configuration of FIG. 5 shows treatment occurring immediately prior to placement of the window spacer assembly, it will appreciated that in various embodiments the spacer assembly can be treated at any point after coming off of a roll (or other storage configuration). Also, in some embodiments it is possible that a short period of time can pass in between the spacer assembly being treated and the spacer assembly being used in the assembly of a glazing unit.

In some embodiments, the window spacer assembly can be treated after it is applied to one or more sheets of glass.

Figure 6:
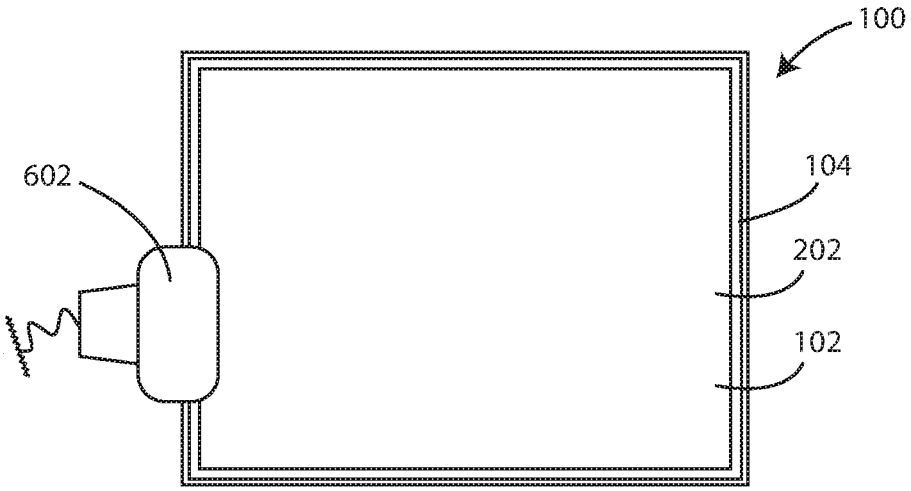
FIG. 6 is a schematic view of a glazing unit during assembly in accordance with various embodiments herein.

Referring now to FIG. 6, a schematic view is shown of a glazing unit 100 during assembly in accordance with various embodiments herein. The glazing unit 100 can include a first sheet of glass 102, a second sheet of glass 202, and a window spacer assembly 104 disposed between the first sheet of glass 102 and second sheet of glass 202. In this embodiment, a surface treatment device 602 can be used to treat an outer surface of the window spacer assembly 104 (such as, but not limited to, an outer surface of the moisture vapor barrier layer) after the window spacer assembly 104 has been fastened between the first sheet of glass 102 and the second sheet of glass 202.

As a result of surface treatment, the outer surface of the moisture vapor barrier layer can have a surface energy (dyn/cm or "dyne" which refers to dyn/cm) that is higher than the surface energy of the inner surface (which in some instances can be bonded to the spacer body and therefore shielded from the surface treatment or be the underside of the spacer itself where the material forming the spacer body has sufficient moisture vapor resistance). In some embodiments, the surface energy of the outer surface is greater than 32 dyn/cm. In some embodiments, the surface energy of the outer surface is greater than 40 dyn/cm. In some embodiments, the surface energy of the outer surface is greater than 45 dyn/cm. In some embodiments, the surface energy of the outer surface is greater than 50 dyn/cm. In some embodiments, the surface energy of the outer surface is greater than 60 dyn/cm. In some embodiments, the outer surface includes oxidized groups at a greater concentration than the inner surface.

As a result of surface treatment, the outer surface of the moisture vapor barrier layer can have a surface energy (dyn/cm) that is increased by at least a threshold amount. In some embodiments, the surface energy of the outer surface is increased by at least 2 dyn/cm. In some embodiments, the surface energy of the outer surface is increased by at least 3 dyn/cm. In some embodiments, the surface energy of the outer surface is increased by at least 4 dyn/cm. In some embodiments, the surface energy of the outer surface is increased by at least 5 dyn/cm. In some embodiments, the surface energy of the outer surface is increased by at least 8 dyn/cm. In some embodiments, the surface energy of the outer surface is increased by at least 10 dyn/cm. In some embodiments, the surface energy of the outer surface is increased by at least 20 dyn/cm. In some embodiments, the surface energy of the outer surface is increased by at least 30 dyn/cm. In some embodiments, the surface energy of the outer surface is increased by at least 40 dyn/cm.

Figure 7:
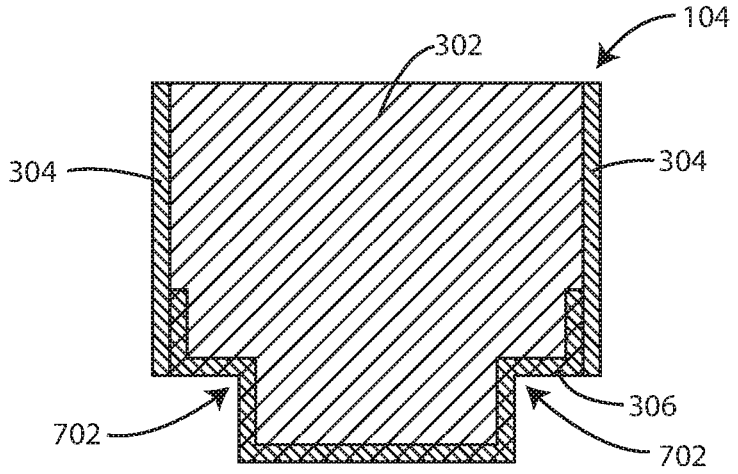
FIG. 7 is a schematic cross-sectional view of a window spacer assembly in accordance with various embodiments herein.

It will be appreciated that window spacer assemblies in accordance with embodiments herein can have many different physical configurations. Referring now to FIG. 7, a schematic cross-sectional view is shown of a window spacer assembly 104 in accordance with various embodiments herein. In this embodiment, the window spacer assembly 104 includes a spacer body 302 and first sealants 304 disposed on the lateral surfaces of the window spacer assembly 104. The window spacer assembly 104 can also include a moisture vapor barrier layer 306. The window spacer assembly 104 can define channels 702 on the bottom lateral edges of the window spacer assembly 104. The channels 702 can serve various functions. In some embodiments, a secondary sealant can be applied in the channels 702 and may or may not extend across the entire outer surface of the window spacer assembly 104.

In some embodiments, window spacer assemblies herein can include a layer of a material that can serve to enhance the adhesion improving effects of surface treatment. For example, in some embodiments, the window spacer assembly can include a primer layer disposed over at least the outer surface of the window spacer assembly. In some embodiments, the window spacer assembly can include a layer of a polymer that yields a surface with a relatively high surface energy after treatment.

Figure 8:
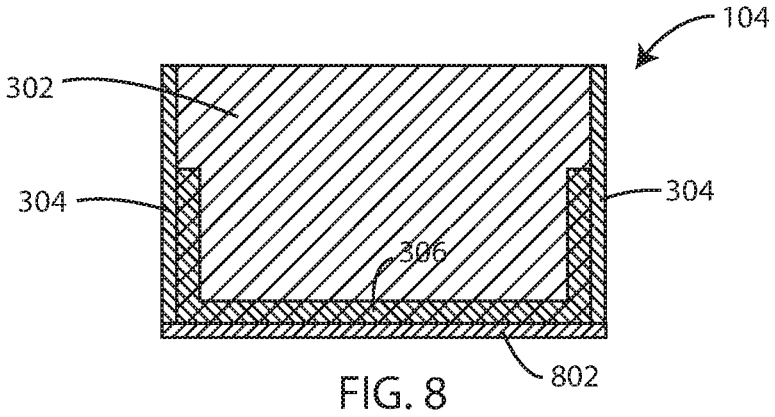
FIG. 8 is a schematic cross-sectional view of a window spacer assembly in accordance with various embodiments herein.

FIG. 8 is a schematic cross-sectional view of a window spacer assembly 104 in accordance with various embodiments herein. The window spacer assembly 104 includes a spacer body 302, a moisture vapor barrier layer 306, first sealants 304 disposed over the lateral sides of the window spacer assembly 104, and a layer of material 802 that can serve to enhance the adhesion improving effects of surface treatment described herein. As described above, the layer of material 802 can be a primer material or a layer of a polymer that yields a surface with a relatively high surface energy after treatment. By way of example, the layer of material 802 can include, but is not limited to, metallized polymer films, multilayer films incorporating polyethylene terephthalate (PET) or polystyrene and the like.

Figure 9:
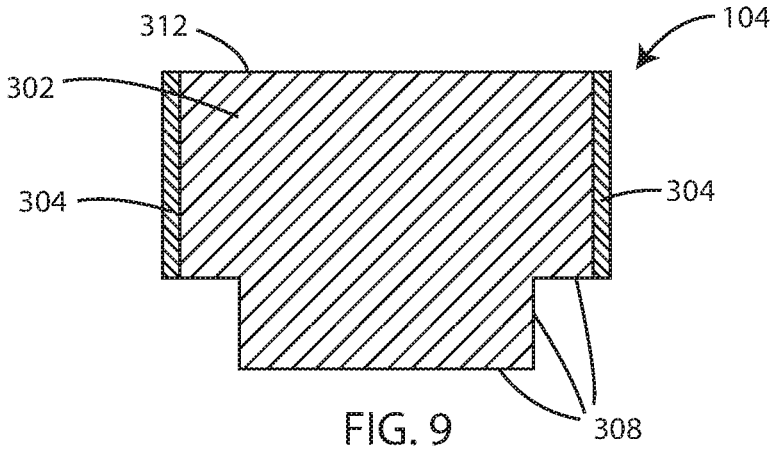
FIG. 9 is a schematic cross-sectional view of a window spacer assembly in accordance with various embodiments herein.

In some embodiments, a separate moisture vapor barrier layer can be omitted. By way of example, the spacer body can be formed of a material that provides sufficient moisture vapor barrier properties without a distinct moisture vapor barrier layer. Referring now to FIG. 9, a schematic cross-sectional view of a window spacer assembly is shown in accordance with various embodiments herein. The window spacer assembly 104 includes a spacer body 302 having an inner surface 312 and outer surfaces 308. The window spacer assembly 104 can also include first sealants 304 disposed on the lateral surfaces of the window spacer assembly 104. In some embodiments, the outer surface of the spacer body can have a different surface energy than the lateral surfaces of the spacer body (which may be covered by the first sealant during the surface treatment process).

Figure 10:
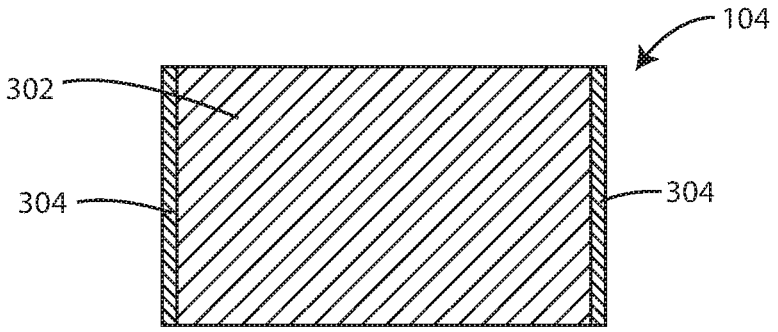
FIG. 10 is a schematic cross-sectional view of a window spacer assembly in accordance with various embodiments herein.

It will be appreciated that many different physical configurations of window spacer assemblies are contemplated herein. Referring now to FIG. 10, a schematic cross-sectional view is shown of a window spacer assembly in accordance with various embodiments herein. In this embodiment, the spacer body 302 is substantially rectangular and first sealants 304 are disposed on the lateral sides.

Figure 11:
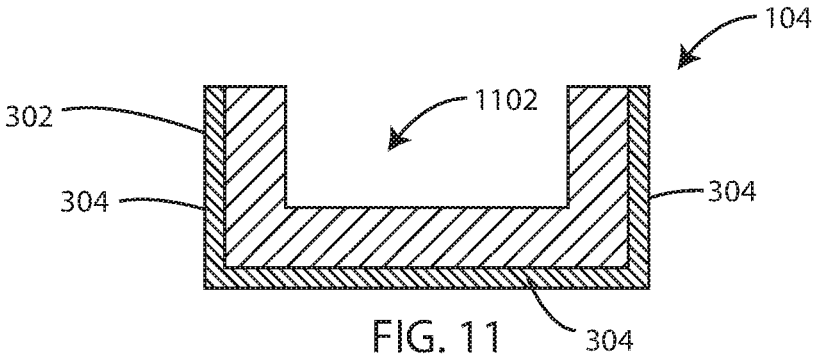
FIG. 11 is a schematic cross-sectional view of a window spacer assembly in accordance with various embodiments herein.

The spacer body itself can take on many different shapes. In some embodiments, it can define a channel or gap. Referring now to FIG. 11, a schematic cross-sectional view is shown of a window spacer assembly in accordance with various embodiments herein. In this embodiment, the spacer body 302 forms a U-shape and defines a channel 1102. In some embodiments, components such as desiccants can be disposed within channel 1102. A first sealant 304 can be disposed on the lateral sides and the outer (outward facing) surface. However, in some embodiments, a first sealant 304 can be disposed on the lateral sides and a second sealant can be disposed on the outer surface.

Figure 12:
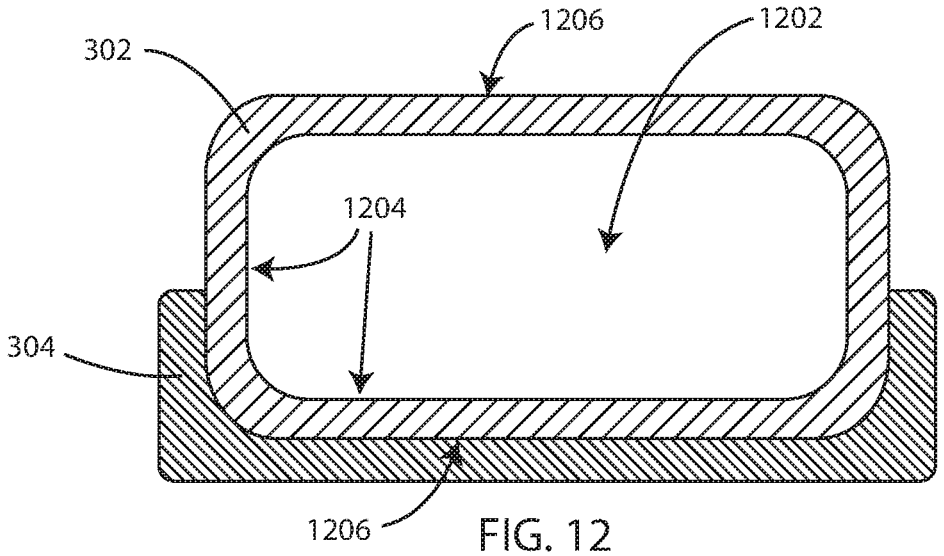
FIG. 12 is a schematic cross-sectional view of a window spacer assembly in accordance with various embodiments herein.

Referring now to FIG. 12, a schematic cross-sectional view is shown of a window spacer assembly in accordance with various embodiments herein. The window spacer assembly includes a spacer body 302. The spacer body 302 defines an interior cavity 1202 (or lumen). The spacer body 302 includes surfaces 1204 facing the interior cavity (luminal surfaces) and surfaces 1206 facing away from the interior cavity (abluminal surfaces). A first sealant 304 can be disposed on at least some of the surfaces 1206 facing away from the interior cavity 1202. The first sealant 304 can serve the functions of a primary and/or a secondary sealant as described herein. In various embodiments, the surfaces 1204 of the spacer body facing the interior cavity can have a different surface energy than at least some of the surfaces 1206 facing away from the interior cavity.

Figure 13:
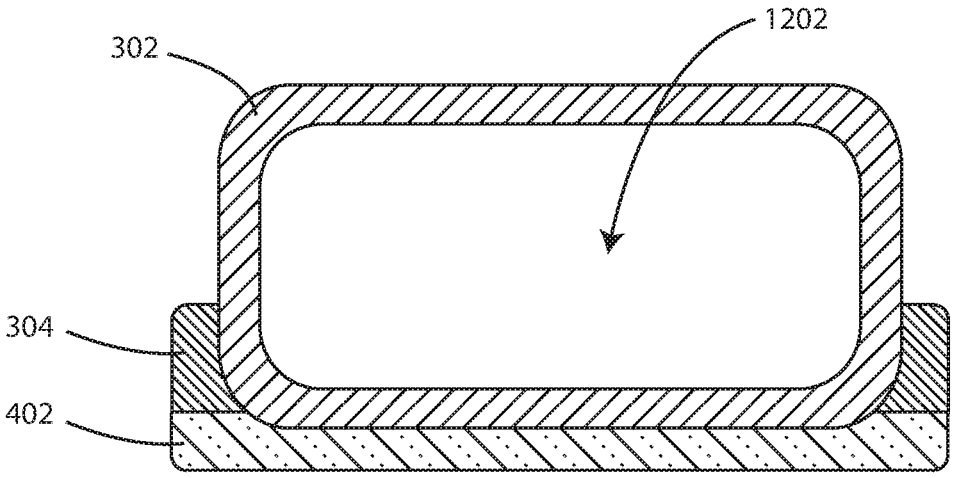
FIG. 13 is a schematic cross-sectional view of a window spacer assembly in accordance with various embodiments herein.

Referring now to FIG. 13, a schematic cross-sectional view is shown of a window spacer assembly in accordance with various embodiments herein. This embodiment is generally similar to that of FIG. 12 except that a first sealant 304 and a separate second sealant 402 are included.

Surface Energy Enhancing Treatments

It will be appreciated that the surface energy of a material surface can be increased in various ways. In some embodiments, corona treatment (corona-discharge treatment) can be used to increase the surface energy of a surface. By way of example, a high-voltage, high-frequency electrical current can be applied, such as damped waves, sine waves and square waves. The output voltage may, for example, range from 6 KV to 16 KV (max. 60 KV) and the frequency used may range from 10 KC/sec. to 50 KC/sec. (max. 1 mega C/sec.). In some embodiments, flame treatment can be used to increase the surface energy of a surface. For example, a surface can be exposed to a hot oxidizing flame for a defined period of time. In some embodiments, plasma treatment can be used to increase the surface energy of a surface. Various aspects of surface treatment are described in U.S. Pat. No. 3,900,538, the content of which is herein incorporated by reference. In some embodiments, chemical primers may be used to increase the surface energy of a surface. Various aspects of using chemical primers to promote bonding are described in U.S. Pat. No. 6,984,287, as one example, the content of which is herein incorporated by reference.

Sealants

First sealants herein can include many different types of adhesives. In some embodiments, the first sealant can include an adhesive or sealant material such as polyisobutylene (PIB), butyl, acrylic, and polysiloxane (silicone), and copolymers of any of these. First sealants can also include polyurethanes, polysulfides, styrene-butadiene polymers and the like.

First sealant materials can also include one or more polyolefins, such as polyethylenes, or may include polyvinyl acetates, polyamides, hydrocarbon resins, asphalts, bitumens, waxes, paraffins, crude rubbers, fluorinated rubbers, polyvinyl chloride, polyamides, fluorocarbons, polystyrene, polypropylenes, cellulosic resins, acrylic resins, thermoplastic elastomers, styrene butadiene resins, ethylene propylene terpolymers prepared from ethylene propylene diene monomer, polyterpenes, and mixtures thereof.

The sealant materials can also include one or more curable materials such as one or more moisture curable polysulfides, polydimethylsiloxanes, oxygen curable polysulfides, and mixtures thereof, which may contain silicon functionalities. Suitable curable materials herein can include alkoxy, acetoxy, oxyamino silane terminated polyethers and polyether urethanes; alkyl siloxane polymers crosslinked with alkoxy, acetoxy, oxyamino organo functional silanes; moisture curable isocyanate functional polyoxyalkalene polymers and polyalkalene polymers; thiol functional polymers and oligomers (such as polyethers, polyether urethanes, polysulfides, polythioethers), suitably catalyzed to produce moisture curable systems; epoxide functional polymers and oligomers with moisture deblockable crosslinkers; acrylic functional polymers with deblockable crosslinkers, UV curable acrylic polymers, and mixtures thereof. The curable material can include one or more alkoxy silane terminated polyurethanes, alkoxy silane terminated polyethers, polydimethylsiloxane polymers, organo functional silanes, and mixtures thereof. The sealant materials can also include tackifiers, catalysts, accelerators, plasticizers, fillers, pigments, antioxidants, weatherability improvers, and similar components as are known in the art.

Aspects of sealants are described in U.S. Publ. Pat. Appl. No. 2010/0255224 and U.S. Pat. No. 6,796,102, the content of which is herein incorporated by reference.

Second sealants herein can include many different types of adhesives. In some embodiments, the second sealant can include a material described above with regard with first sealants. In some embodiments, the second sealant can include an acrylate polymer containing curable silyl groups.

The term "primary sealant" in the context of window spacers typically refers to a sealant that functions to prevent gases within the insulating space between sheets of glass from escaping and further functions to prevent moisture from leaking into the insulating space. The term "secondary sealant" in the context of window spacers typically refers to a sealant that functions to provide structural integrity to the glazing unit. In some embodiments, first sealants referred to herein can function as primary sealants. However, in some embodiments, first sealants can also function as secondary sealants in addition to or instead of functioning as primary sealants. Similarly, in some embodiments, second sealants referred to herein can function as secondary sealants. However, in some embodiments, second sealants can also function as primary sealants in addition to or instead of functioning as secondary sealants.

Moisture Vapor Barrier Layer

Various embodiments herein include a moisture vapor barrier layer. The moisture vapor barrier layer can be a gas impermeable barrier film. In some embodiments, the moisture vapor barrier layer can be a film having a water vapor transmission rate (at 100 degrees Fahrenheit—ASTM E-96, Procedure E) of less than 1.9, 1.8, 1.7, 1.6, 1.5, 1.4, 1.3, 1.2, 1.1, 1.0, 0.9, 0.8, 0.7, 0.6, 0.5, 0.4, 0.3, or 0.2 g/100 $in^2$/24 hours.

The moisture vapor barrier layer can include an inner surface and an outer surface. In various embodiments, the outer surface of the moisture vapor barrier layer has a different surface energy than the inner surface. By way of example, the moisture vapor barrier layer can be bonded to the rest of the window spacer assembly (such as bonded to the spacer body) prior to a surface treatment step. As such, the exposed outer surface of the moisture vapor barrier layer can end up having a surface energy that is higher than the surface energy of the covered inner surface. In some instances, the moisture vapor barrier layer may be the same as the material comprising the body of the spacer, such as the case in many metal spacers.

The moisture vapor barrier layer can be made up of many different materials and sublayers. By way of example, the moisture vapor barrier layer can include a polymeric sublayer and, in some embodiments, a metal sublayer to enhance the resistance to the transmission of gases including water vapor. In some embodiments, the moisture vapor barrier layer includes a metal foil sublayer. In some embodiments, the moisture vapor barrier layer includes a layer of a polyester and a layer of a vapor deposited metal. In some embodiments, the moisture vapor barrier can include a metallized film. In some embodiments, the moisture vapor barrier layer includes a layer of polyethylene terephthalate and a layer of a vapor deposited metal. In some embodiments, the moisture vapor barrier layer includes a layer of BoPET (biaxially-oriented polyethylene terephthalate) metallized with aluminum (or another metal) (MYLAR). In some embodiments, the moisture vapor barrier layer can include a sublayer (such as an outer layer) of polystyrene.

Figure 14:
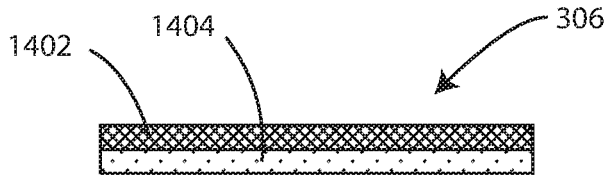
FIG. 14 is a schematic cross-sectional view of a moisture vapor barrier layer in accordance with various embodiments herein.

Referring now to FIG. 14, a schematic cross-sectional view is shown of a moisture vapor barrier layer 306 in accordance with various embodiments herein. The moisture vapor barrier layer 306 can include a polymeric sublayer 1402 and a metallic sublayer 1404.

Figure 15:
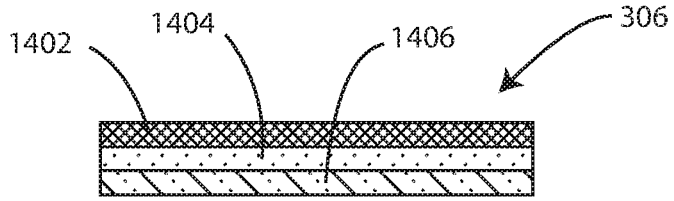
FIG. 15 is a schematic cross-sectional view of a moisture vapor barrier layer in accordance with various embodiments herein.

Referring now to FIG. 15, a schematic cross-sectional view of a moisture vapor barrier layer 306 is shown in accordance with various embodiments herein. The moisture vapor barrier layer 306 can include a polymeric sublayer 1402, a metallic sublayer 1404, and a second polymer sublayer 1406.

In some embodiments, the moisture vapor barrier layer can include different materials across its width. In some embodiments, the moisture vapor barrier layer can include a thermal break disposed at a position along the width of the moisture vapor barrier layer. In some embodiments, the moisture vapor barrier layer can include multilayer films with one or more layers of metals and polymers. In some embodiments, the moisture vapor barrier layer may only include a single layer or material, such as a single layer of a metal or another vapor impermeable material.

Figure 16:
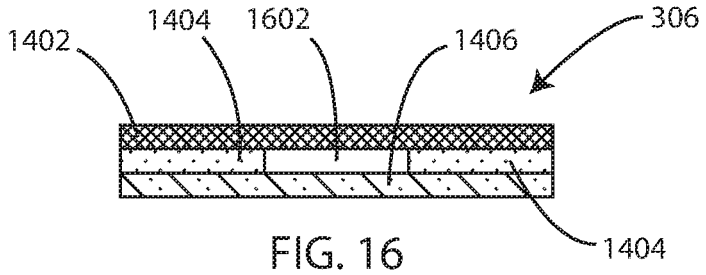
FIG. 16 is a schematic cross-sectional view of a moisture vapor barrier layer in accordance with various embodiments herein.

Referring now to FIG. 16, a schematic cross-sectional view of a moisture vapor barrier layer 306 in accordance with various embodiments herein is shown. The moisture vapor barrier layer 306 can include a polymeric sublayer 1402, a metallic sublayer 1404, and a second polymer sublayer 1406. However, the metallic sublayer 1404 can be interrupted by a thermal insulating material 1602, or at least a material having less thermal conductivity than the metallic sublayer or another layer of the barrier layer, creating a thermal break along the width of the moisture vapor barrier layer.

In various embodiments, the moisture vapor barrier may not necessarily be comprised of a separate film, but can be part of a material or component forming the spacer assembly (such as the spacer body). For example, the spacer body itself can be formed of a material (or can include a material) that functions as a moisture vapor barrier. In some embodiments, the spacer body can be relatively homogeneous in nature and offer a sufficient level of moisture vapor resistance in conjunction with the sealants used in forming the insulating glass unit or glazing unit. In such instances, the spacer back (or spacer body back or outwardly facing surface) can be treated directly to promote adhesion between the spacer and the sealants.

In various embodiments herein, glazing units can include desiccants. Desiccants can be disposed adjacent to window spacers or within channels or pockets formed by window spacers in various embodiments. In some embodiments, desiccants can be disposed within window spacer assemblies such as dispersed within polymers used to make window spacer assemblies. The desiccant can be any conventional desiccant material including, but not limited to, molecular sieve and silica gel type desiccants.

Additional Window Spacer Assembly Constructions

Many different window spacer assembly constructions are within the scope herein. Some window spacers can include a spacer body that is formed in whole or in part from a polymeric material. Other window spacers have one or more wall portions that can be formed of a metal. In some embodiments, window spacers having one or more wall portions formed of metal may not include a separate moisture vapor barrier layer. Rather, the metal may itself be impermeable to moisture vapor.

Many metals are known to have relatively high surface energies making them favorable materials to durably adhere things thereto. However, sometimes after various processing steps have been performed including but not limited to bending, cleaning, storing, etc., the metal surfaces of the window spacer assembly can have a surprisingly low surface energy. This is shown below in Example 2. This can adversely impact the adhesion and dimensional stability of materials bonded to the surface(s). As such, in various embodiments herein, one or more metal surfaces of a window spacer assembly can be treated in order to raise the surface energy thereof and promote better bonding.

Figure 17:
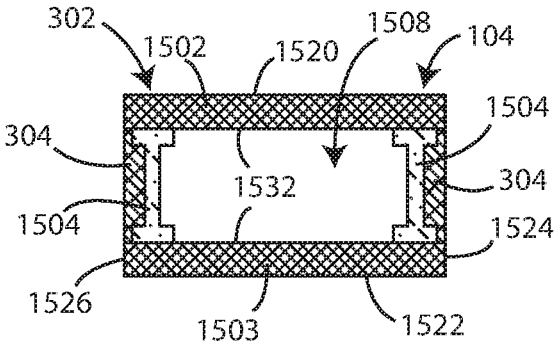
FIG. 17 is a schematic cross-sectional view of a windows spacer assembly in accordance with various embodiments herein.

Referring now to FIG. 17, a window spacer assembly 104 is shown in accordance with various embodiments herein. In this embodiment, the window spacer assembly 104 including an inner wall 1502 formed of a metal and an outer wall 1503 formed of a metal. Together, the inner wall 1502 and the outer wall 1503 can form a spacer body 302 or a portion thereof. The spacer body 302 can define an interior volume 1508 or cavity. A first sealant 304 is shown disposed over the lateral sides of the spacer body 302.

The spacer body 302 can include internal surfaces 1532 bordering (or facing) the interior volume. The spacer body 302 can also include external surfaces including, but not limited to an inner surface 1520, outer surface 1522, and lateral surfaces 1524, 1526. One or more of the external surfaces can be treated to raise the surface energy thereof. As such, in some embodiments, one or more of the outer surface and lateral surfaces can have a different surface energy than the internal surfaces bordering the interior volume.

In some embodiments, a desiccant material (not shown in this view) can be disposed within the interior volume 1508 or cavity. In some embodiments, the window spacer assembly can include supports 1504 disposed between the inner wall 1502 and the outer wall 1503. The supports 1504 can be formed of a polymeric material, a metal, a composite, or the like.

Figure 18:
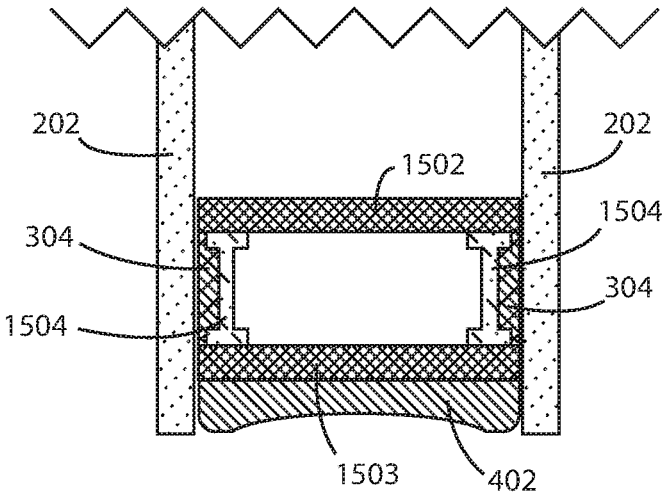
FIG. 18 is a schematic cross-section view of a glazing unit including a window spacer assembly as shown in FIG. 17 in accordance with various embodiments herein.

FIG. 18 shows the window spacer assembly 104 of FIG. 17 as positioned between sheets of glass 202 and forming a portion of a glazing unit with a second sealant 402 disposed over the outer surface of the spacer body between the sheets of glass 202.

Figure 19:
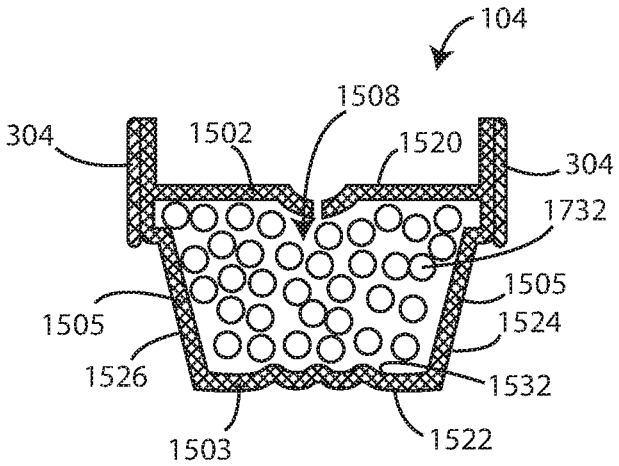
FIG. 19 is a schematic cross-sectional view of a windows spacer assembly in accordance with various embodiments herein.

Referring now to FIG. 19, a window spacer assembly 104 is shown in accordance with various embodiments herein. In this embodiment, the window spacer assembly 104 including an inner wall 1502 formed of a metal, an outer wall 1503 formed of a metal, and lateral walls 1505 formed of a metal. Together, the inner wall 1502, outer wall 1503, and lateral walls 1505 can form a spacer body 302 or a portion thereof. The spacer body 302 can define an interior volume 1508 or cavity. A first sealant 304 is shown disposed over the lateral sides of the spacer body 302.

The spacer body 302 can include internal surfaces 1532 bordering (or facing) the interior volume. The spacer body 302 can also include external surfaces including, but not limited to an inner surface 1520, outer surface 1522, and lateral surfaces 1524, 1526. One or more of the external surfaces can be treated to raise the surface energy thereof. As such, in some embodiments, one or more of the outer surface and lateral surfaces can have a different surface energy than the internal surfaces bordering the interior volume.

In some embodiments, a desiccant material 1732 can be disposed within the interior volume 1508 or cavity.

Figure 20:
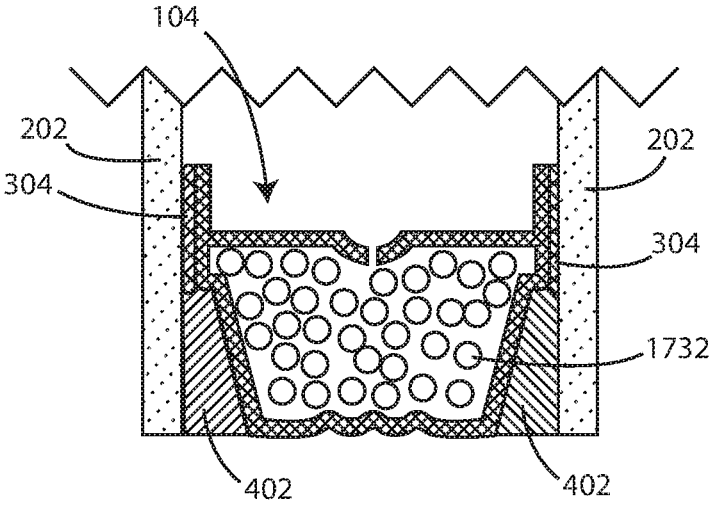
FIG. 20 is a schematic cross-section view of a glazing unit including a window spacer assembly as shown in FIG. 19 in accordance with various embodiments herein.

FIG. 20 shows the window spacer assembly 104 of FIG. 19 as positioned between sheets of glass 202 and forming a portion of a glazing unit with a second sealant 402 disposed over the lateral surfaces of the spacer body between the sheets of glass 202.

Figure 21:
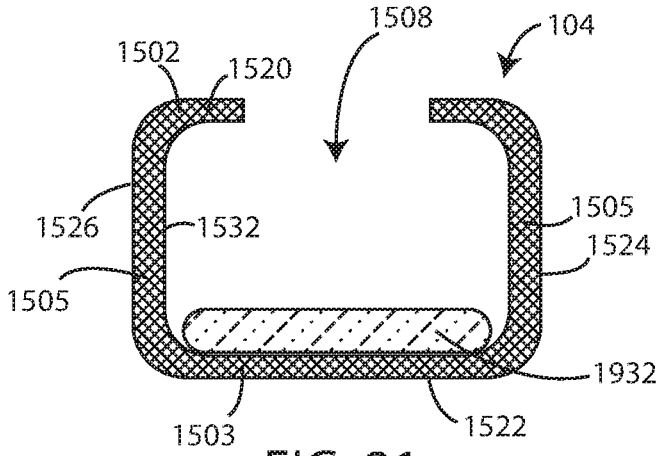
FIG. 21 is a schematic cross-sectional view of a windows spacer assembly in accordance with various embodiments herein.

Referring now to FIG. 21, a window spacer assembly 104 is shown in accordance with various embodiments herein. In this embodiment, the window spacer assembly 104 including an inner wall 1502 formed of a metal, an outer wall 1503 formed of a metal, and lateral walls 1505 formed of a metal. Together, the inner wall 1502, outer wall 1503, and lateral walls 1505 can form a spacer body 302 or a portion thereof. The spacer body 302 can define an interior volume 1508 or cavity. A first sealant 304 is shown disposed over the lateral sides of the spacer body 302.

The spacer body 302 can include internal surfaces 1532 bordering (or facing) the interior volume. The spacer body 302 can also include external surfaces including, but not limited to an inner surface 1520, outer surface 1522, and lateral surfaces 1524, 1526. One or more of the external surfaces can be treated to raise the surface energy thereof. As such, in some embodiments, one or more of the outer surface and lateral surfaces can have a different surface energy than the internal surfaces bordering the interior volume.

In some embodiments, a desiccant material 1932 can be disposed within the interior volume 1508 or cavity.

Figure 22:
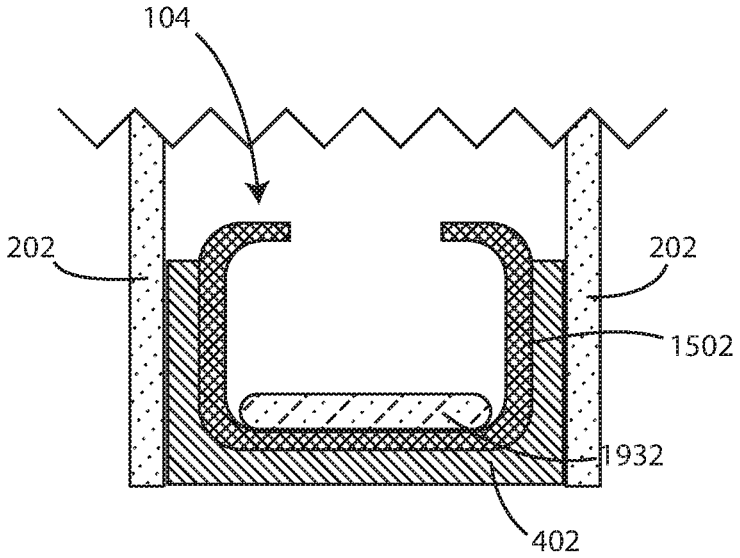
FIG. 22 is a schematic cross-section view of a glazing unit including a window spacer assembly as shown in FIG. 21 in accordance with various embodiments herein.

FIG. 22 shows the window spacer assembly 104 of FIG. 21 as positioned between sheets of glass 202 and forming a portion of a glazing unit with a second sealant 402 disposed over the outer and lateral surfaces of the spacer body 302 between the sheets of glass 202.

Methods

In some embodiments, a method for making a glazing unit is included. The method can include treating an outer surface of the window spacer assembly to increase the surface energy thereof. The method can further include depositing the window spacer assembly around the outer perimeter of a first sheet of glass. The spacer can be attached to the first sheet of glass either with pre-applied first sealant or applying sealant just prior to attachment to the glass. The method can further include attaching a second sheet of glass onto the window spacer assembly, such that the window spacer assembly is disposed between the first sheet of glass and the second sheet of glass. The method can further include applying a sealant layer (second sealant) on the outer surface of the window spacer assembly between the first sheet of glass and the second sheet of glass. In some embodiments, treating an outer surface of the window spacer assembly includes subjecting the outer surface to corona treatment. In some embodiments, treating an outer surface of the window spacer assembly includes subjecting the outer surface to flame treatment. In some embodiments, treating an outer surface of the window spacer assembly includes subjecting the outer surface to plasma treatment. In some embodiments, treating an outer surface of the window spacer assembly includes applying a chemical priming treatment. The treatment step may be completed either prior to attachment to the first sheet of glass or after, but before secondary sealant is applied to the back of the spacer during the insulating glass assembly process.

In various embodiments, the method can also include inserting a desiccant material into the space between the sheets of glass (insulating space). The desiccant can be any conventional desiccant material including, but not limited to, molecular sieve, silica gel type desiccants, and desiccated foam or combinations thereof. In some embodiments, the desiccant can be integrated into the spacer body. In some embodiments, the desiccant can be a separate material that is added into a cavity in the spacer body or another portion of the glazing unit.

In various embodiments, the method can also include inserting a gas into the space between the sheets of glass (insulating space). By way of example, air, argon, or krypton gases can be injected into the insulating space.

Aspects may be better understood with reference to the following examples. These examples are intended to be representative of specific embodiments, but are not intended as limiting the overall scope of embodiments herein.

EXAMPLES

Example 1: Peel Adhesion of Treated Spacer Assemblies

Peel adhesion between a spacer and typical glazing sealant was conducted. Samples were prepared by taking spacer material cut into 8" strips, applying hot melt sealant directly onto the back of the spacer, and subsequently pushing by hand a wire mesh (½" wide cut into 8" strips) on top of the sealant to fully wet out contact between the sealant and the spacer. The spacer used in this test was a SUPER SPACER PREMIUM spacer commercially available from Quanex. The sealant was a reactive hot melt adhesive (5160 commercially available from HB Fuller).

Dyne measurements were taken with Con-Trol-Cure Liquid Dyne Pens per the standard measurement procedure (consistent with ASTM D2578-04a), supplied by UV Process Supply, Inc. Initial surface energy on the spacers was measured and found to be consistently below 36 dyne.

Surface treatment was performed using a Dyne-A-Mite IT plasma treater (Model LM4816-21HB_B106D), produced by Enercon 3D Surface Treatment. The plasma head was positioned 0.250" above the back surface of the spacer. A line speed of 50 fpm was set and the spacers were placed on a shuttle maintaining alignment of the spacer directly under the plasma head through the equipment.

After treatment, surface energy was again measured and all samples were consistently above 48 dyne.

The strips were then tested for peel adhesion (as a t-peel) using an MTS. The sample was clamped such that the spacer was in one clamp and the mesh impregnated with sealant was in the other clamp. Cross head speed moved at approximately 10 in/min while the force was measured and recorded. Peels that resulted in structural failure of either the spacer or the sealant, as well as those exhibiting cohesive failure, were noted as a "Pass" since the adhesive bonding between the sealant and substrate did not fail. Those strips that failed resulting from adhesion loss at the interfacial bond were designated as failures.

| Spacer Surface Energy | Number Samples "Pass" Peel Adhesion | Number Samples "Fail" Peel Adhesion |
|---|---|---|
| <36 | 3 | 7 |
| >48 | 6 | 4 |

Example 2: Feasibility of Increasing Surface Energy of Multiple Spacers

A Dyne-A-Mite IT plasma treater (Model LM4816-21HB_B106D), produced by Enercon 3D Surface Treatment was used to plasma treat the surface of a variety of insulating glass spacers (specifically including some with metallized polymer film surfaces and some with metal surfaces). The plasma head was positioned 0.250" above the back surface of the spacer. A line speed of 50 fpm was set and the spacers were placed on a shuttle maintaining alignment of the spacer directly under the plasma head through the equipment.

Measurements of surface energy were measured before and after treatment. The lowest surface energy pen available was a pen with 36 dyne fluid and the highest surface energy pen was a pen with 60 dyne fluid. Remarkably, the metal surfaces tested were found to have a surface energy less than 36 dyne.

All spacers were initially less than 36 dyne prior to treatment and successfully raised to greater than 60 dyne after treatment.

| Spacer | Spacer Surface Description | Initial Dyne Measurement | Treated Dyne Measurement |
|---|---|---|---|
| Super Spacer Premium by Quanex | metallized polymer film | <36 | >60 |
| EnerEdge by Tremco | Metallized polymer film | <36 | >60 |
| Thermobar warm edge spacer - Thermoseal Group in the UK | Metallized polymer film | <36 | >60 |
| Multitech from Roll Tech A/S | Metalized polymer film | <36 | >60 |
| Alu Pro from Aluminum Profiles | Painted Aluminum | <36 | Between 48-60 |
| Chromatech by Roll Tech | Unknown metal | <36 | >60 |
| Intercept by PPG | Tin plated | <36 | >60 |
| XL Edge by Cardinal | Stainless Steel | <36 | >60 |

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

Aspects have been described with reference to various specific and preferred embodiments and techniques. However, it should be understood that many variations and modifications may be made while remaining within the spirit and scope herein.

The invention claimed is:

1. A window spacer assembly comprising:

a spacer body having an inner surface, outer surface, and lateral surfaces;

a first sealant disposed on the lateral surfaces; and a moisture vapor barrier disposed over the outer surface, the moisture vapor barrier comprising a layer having an inner surface and an outer surface;

wherein the outer surface of the layer is the same material as the inner surface of the layer;

wherein the outer surface of the layer has a surface energy (dyn/cm) that is higher than the surface energy of the inner surface.

2. The window spacer assembly of claim 1, wherein the surface energy of the outer surface is greater than 32 dyn/cm.

3. The window spacer assembly of claim 1, wherein the surface energy of the outer surface is greater than 60 dyn/cm.

4. The window spacer assembly of claim 1, wherein the outer surface includes oxidized groups at a greater concentration than the inner surface.

5. The window spacer assembly of claim 1, the spacer body comprising a deformable polymer.

6. The window spacer assembly of claim 1, the moisture vapor barrier having a width, the moisture vapor barrier comprising different materials across its width.

7. The window spacer assembly of claim 1, the moisture vapor barrier having a width, the moisture vapor barrier comprising a thermal break disposed along its width.

8. The window spacer assembly of claim 1, the moisture vapor barrier having a water vapor transmission rate at 100 degrees Fahrenheit of less than 1.9 g/100 $in^2$/24 hours.

9. The window spacer assembly of claim 8, the moisture vapor barrier comprising a metal foil layer.

10. The window spacer assembly of claim 8, the moisture vapor barrier comprising a layer of a polyester and a layer of a vapor deposited metal.

11. The window spacer assembly of claim 8, the moisture vapor barrier comprising a layer of polyethylene terephthalate and a layer of a vapor deposited metal.

12. The window spacer assembly of claim 8, the moisture vapor barrier comprising an outer layer of polystyrene.

13. The window spacer assembly of claim 1, the first sealant comprising a material selected from the group consisting of polyisobutylene, acrylic, and polysiloxane.

14. The window spacer assembly of claim 1, the window spacer assembly having a width, the moisture vapor barrier having a width equal to the width of the window spacer assembly.

15. The window spacer assembly of claim 1, further comprising a second sealant contacting the outer surface of the moisture vapor barrier.

* * * * *